US010486893B2

(12) United States Patent
Snyder et al.

(10) Patent No.: US 10,486,893 B2
(45) **Date of Patent: *Nov. 26, 2019**

(54) CONTAINER WITH MEANS FOR IMPROVED CLOSURE

(71) Applicant: PHILIP MORRIS PRODUCTS S.A., Neuchatel (CH)

(72) Inventors: Anthony Snyder, Le Mont sur Lausanne (CH); Onesio Luis Thesing, Ecublens (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/736,882

(22) PCT Filed: May 31, 2017

(86) PCT No.: PCT/EP2017/063224

§ 371 (c)(1),
(2) Date: Dec. 15, 2017

(87) PCT Pub. No.: WO2017/207667

PCT Pub. Date: Dec. 7, 2017

(65) Prior Publication Data

US 2018/0170659 A1 Jun. 21, 2018

(30) Foreign Application Priority Data

May 31, 2016 (EP) ..... 16172301

(51) Int. Cl.
*B65D 85/10* (2006.01)

(52) U.S. Cl.
CPC ..... *B65D 85/1045* (2013.01); *B65D 85/1081* (2013.01)

(58) Field of Classification Search
CPC .. B65D 5/0281; B65D 75/58; B65D 75/5838; B65D 85/10; B65D 85/1036; B65D 85/1045; B65D 85/1081
(Continued)

(56) References Cited

U.S. PATENT DOCUMENTS 7,731,024 B2 6/2010 Bouno
9,132,605 B2 9/2015 Nguyen
(Continued)

FOREIGN PATENT DOCUMENTS

CN 101102945 1/2008
CN 204507761 7/2015
(Continued)

OTHER PUBLICATIONS

Office Action issued in Japan for Application No. 2017-566673 dated Jul. 17, 2018 (6 pages). English translation included.
(Continued)

*Primary Examiner* — Bryon P Gehman
(74) *Attorney, Agent, or Firm* — Mueting, Raasch & Gebhardt, P.A.

(57) ABSTRACT

A container (100) for consumer goods comprises: a housing (20) having an opening for accessing the consumer goods; and a lid (40) connected to the housing (20) and movable relative to the housing (20) between a closed position in which the lid (40) covers the opening and an open position in which the opening is uncovered. A first surface of the lid (40) is disposed adjacent to a first surface of the housing (20) when the lid is in the closed position, and a microsuction structure (60) is provided for securing the first surface of the lid (40) to the first surface of the housing (20) when the lid (40) is in the closed position. The microsuction structure (60) is formed of a microsuction layer (68) and an inactivation layer (70); the microsuction layer (68) comprises: a
(Continued)

Figure 1:
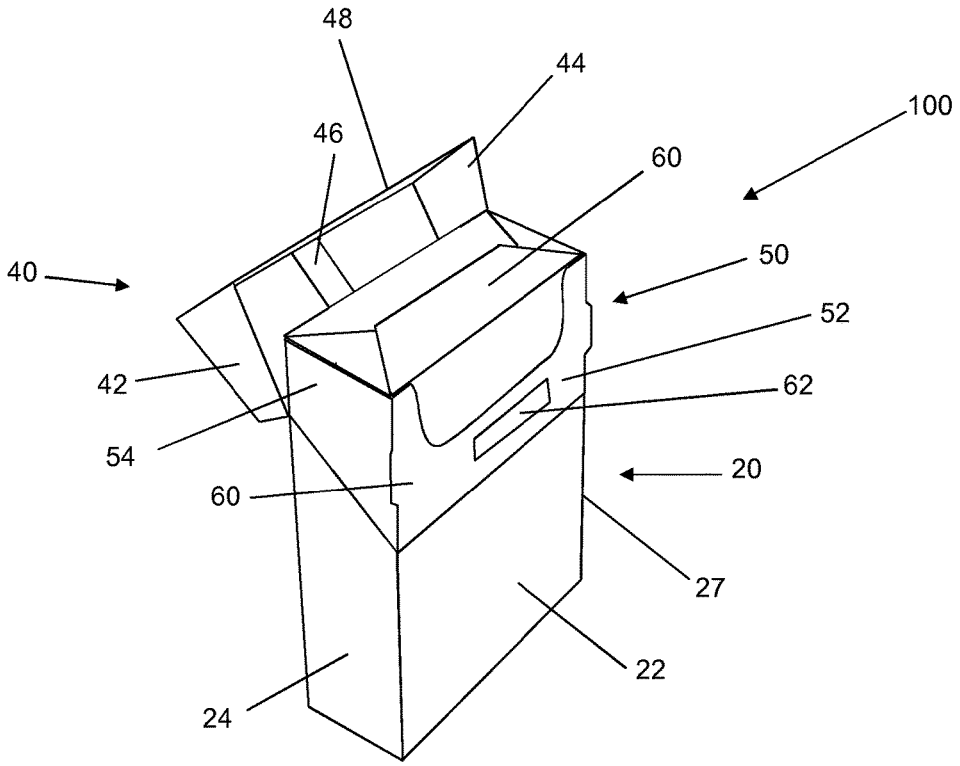

first portion which underlies the inactivation layer (70); and a second portion which is exposed at the outer surface of the microsuction structure (60) to define at least one resealable area of the microsuction structure (60).

15 Claims, 1 Drawing Sheet

(58) Field of Classification Search
USPC ..... 206/264–270
See application file for complete search history.

(56) References Cited

U.S. PATENT DOCUMENTS

| | | | | |
|---|---|---|---|---|
| 10,227,174 | B2 * | 3/2019 | Ng | B65D 85/1045 |
| 2015/0041346 | A1 | 2/2015 | Seyfferth De Oliveira | |
| 2015/0305402 | A1 | 10/2015 | Bourgoin | |

FOREIGN PATENT DOCUMENTS

| | | | | |
|---|---|---|---|---|
| DE | 102014013821 | | 3/2016 | |
| EP | 1837293 | | 9/2007 | |
| EP | 2594507 | A1 * | 5/2013 | B65D 85/1045 |
| EP | 2845498 | | 3/2015 | |
| EP | 3251971 | A1 | 12/2017 | |
| JP | 10158608 | | 6/1998 | |
| JP | 3184144 | U | 6/2013 | |
| JP | 2014-088037 | A | 5/2014 | |
| JP | 2016-506341 | A | 3/2016 | |
| KR | 1020140124367 | | 10/2014 | |
| KR | 10-2018-0001560 | | 1/2018 | |
| WO | WO 2013/068500 | | 5/2013 | |
| WO | WO-2013076012 | A1 * | 5/2013 | B65D 85/1045 |
| WO | WO 2014/096427 | | 6/2014 | |
| WO | WO 2016/059077 | | 4/2016 | |
| WO | WO-2016059077 | A1 * | 4/2016 | B65D 75/5838 |
| WO | WO 2017/036991 | | 3/2017 | |

OTHER PUBLICATIONS

European Extended Search Report for Application No. 16172301.0 dated Nov. 18, 2016 (8 pages).
Office Action issued in Korea for Application No. 2017-7036070 dated Feb. 19, 2018 (9 pages). English translation included.
Notice of Allowance issued in Korea for Application No. 2017-7036070 dated Jun. 20, 2018 (3 pages). English translation included.
International Search Report and Written Opinion for PCT/EP2017/063224 dated Jun. 27, 2017 (12 pages).
Office Action issued in China for Application No. 201780002147.6 dated Dec. 6, 2018 (11 pages). English translation included.

* cited by examiner

CONTAINER WITH MEANS FOR IMPROVED CLOSURE

This application is a U.S. National Stage Application of International Application No. PCT/EP2017/063224, filed May 31, 2017, which was published in English on Dec. 7, 2017, as International Publication No. WO 2017/207667 A1. International Application No. PCT/EP2017/063224 claims priority to European Application No. 16172301.0 dated May 31, 2016.

The present invention relates to a container for consumer goods having a housing and a lid movable relative to the housing, and a method for forming such containers. Containers according to the present invention find particular application as containers for smoking articles, such as cigarettes.

It is known to package elongate smoking articles and other consumer goods in containers formed from folded laminar blanks. Elongate smoking articles, such as cigarettes and cigars, are commonly sold in hinge-lid packs having a box for housing the smoking articles and a lid connected to the box about a hinge line extending across the back wall of the container. The hinge-lid pack may also comprise an inner frame secured to an inner surface of the box, the inner frame having front and side walls against which the lid closes. Such packs are typically constructed from laminar cardboard blanks. In use, the lid is pivoted about the hinge line to open the pack and so gain access to the smoking articles held in the box.

In many cases, it is important to ensure that the lid remains in the closed position during normal handling, so that, for example, the consumer goods do not accidentally get exposed or fall out of the container. For smoking articles it can be particularly important that the lid remains tightly shut in the closed position, so that the freshness of the articles can be preserved.

Various mechanisms have been proposed for improving the interaction between the lid and the box of such containers, and in particular, for reducing the chances of the lid inadvertently moving away from the closed position during normal handling. For example, retention cuts may be provided on the inner frame for interacting with the lid. Alternatively, a temporary adhesive may be provided on the lid or the box. However, such mechanisms deteriorate and become less effective after several repetitions of opening and closing of the lid. This can be particular problematic for containers containing smoking articles, where a consumer may need to open and close the lid on multiple occasions each time they access an individual smoking article.

Furthermore, where an adhesive is provided on the lid or box loose material from the consumer goods—such as loose tobacco material from a smoking article—can become undesirably stuck to the adhesive during use of the container. This can result in an undesirable appearance of the container and a less effectively functioning closing mechanism. This can also create a gap that can allow air to pass into the container when the lid is in a closed position, which can result in an undesired change in the moisture level of the consumer goods.

It would be desirable to provide a container having improved closure means for retaining the lid in a closed position during normal handling. It would be further desirable to provide such a container wherein the closure means retains effectiveness after repeated closure and opening without significant deterioration. It would be particularly desirable to provide such a container that can be manufactured without significant modification of existing container designs or packaging equipment and techniques.

According to a first aspect of the present invention, there is provided a container for consumer goods, the container comprising: a housing having an opening for accessing the consumer goods; and a lid connected to the housing and movable relative to the housing between a closed position in which the lid covers the opening and an open position in which the opening is uncovered. A first surface of the lid is disposed adjacent to a first surface of the housing when the lid is in the closed position, and wherein a microsuction structure is provided on the first surface of the housing, the first surface of the lid, or both the first surface of the housing and the first surface of the lid, for securing the first surface of the lid to the first surface of the housing when the lid is in the closed position. The microsuction structure comprises: an inactivation layer; and a microsuction layer, the microsuction layer comprising: a first portion which underlies the inactivation layer; and a second portion which is exposed at the outer surface of the microsuction structure to define a resealable area of the microsuction structure.

The microsuction structure of a container according to the invention provides a novel and improved closure means for retaining the lid of the container in a closed position between uses.

The term "microsuction structure" is used herein to refer to the laminate structure formed with the microsuction layer, the polymeric film layer and the adhesive layer. The microsuction layer provides the outer surface of the microsuction structure. The microsuction structure is typically provided in the form of a sheet like laminate material.

In containers according to the invention, the microsuction structure is provided over one or both of the first surface of the housing and the first surface of the lid.

The term "microsuction layer" is used herein to refer to a layer formed of a flexible material having a plurality of micro cavities on the external surface of the material. The walls of the micro cavities are deformable, such that, when the external surface of the material is pressed against a contact surface, a sealed environment of reduced pressure is formed between the walls of the cavities and the contact surface. This provides a suction force between the walls of the cavities and the contact surface.

The micro cavities may have a diameter of from 5 micrometres to 300 micrometres. The material may be formed of an expanded resin having a plurality of internal air bubbles. The layer may have a thickness of from about 50 micrometres to about 150 micrometres, more preferably from about 60 micrometres to about 100 micrometres, most preferably about 80 micrometres.

According to the first aspect of the invention, a second portion of the microsuction layer is exposed at the first surface onto which the microsuction structure is applied, in order to provide the area or areas of the container that are capable of repeatedly attaching or affixing to the adjacent first surface. The area or areas of the microsuction structure in which the microsuction layer is exposed are referred to herein as the "resealable area or areas". Consequently, the total surface area of the resealable areas is smaller than the total exposed surface area of the microsuction structure. The term "exposed" is used herein to indicate that said areas are not covered and are therefore able to come into contact with and repeatedly attach to and detach from the contact surface. The resealable areas may be capable of creating at least a partially sealed environment within the container. Alternatively, the resealable areas may simply provide areas of the container that can be repeatedly attached or affixed to a corresponding contact surface, without performing any sealing function.

The inactivation layer partially covers the microsuction layer, and thereby inactivates or otherwise prevents the underlying area of the microsuction layer from becoming affixed to a contact surface. The inactivation layer can therefore be used to define specific resealable areas of exposed microsuction layer, thereby controlling the sealing force and the regions where sealing can occur. The inactivation layer can thereby close or cover up micro cavities on the microsuction layer's surface and prevent them from forming a sealed environment of reduced pressure.

The inactivation layer can conveniently be applied onto the surface of the microsuction structure, prior to assembly of the container. In this way, the resealable area or areas in which the microsuction layer is exposed can be accurately positioned on the container (or a laminar blank that is used to form at least part of the container) so that the one or more resealable areas are provided in the desired position on the assembled container. This can advantageously reduce the registration requirements for placement of the microsuction layer on the container (or a laminar blank that is used for form at least part of the container). Furthermore, this can allow a larger microsuction layer to be used, than otherwise may be possible. This allows a stronger bond to be formed between the microsuction layer and its underlying surface, due to the increased number of available microcavities on the layer's inner surface.

Advantageously, loose material from the consumer goods, for example, loose tobacco from smoking articles, does not stick to the microsuction structure. This enables the appearance and the function of the microsuction structure to be retained during use Preferably, the microsuction structure further comprises one or more additional layers disposed between the inactivation layer and the microsuction layer. Preferably, said one or more additional layers do not overlie the microsuction layer in the one or more sealing areas.

If desired, the areas to which the inactivation layer is applied may be printed with a suitable ink prior to the application of the inactivation layer onto the microsuction layer. Such printing can modify the surface appearance in these areas. In such embodiments, the inactivation layer can further act to protect said printing from being inadvertently degraded, for example by a consumer's fingers. Alternatively, a suitable printed ink may be provided on top of the inactivation layer after the inactivation layer has been provided on the microsuction layer.

Such selective printing may be helpful where it is desired for the consumer to be able to identify the position of the resealable area or areas of the microsuction structure. The ink may be printed using any suitable printing process, including but not limited to flexographic printing, gravure printing, offset printing or digital printing. Preferably, the ink is printed using a flexographic printing process or a gravure printing process, most preferably a flexographic printing process.

Preferably, the microsuction layer extends over the entirety of the corresponding first surface of the lid or housing.

When the lid of containers according to the invention is in the closed position, the first surface of the lid is disposed adjacent to the first surface of the housing so that the surfaces overlap with each other over a first overlapping area. Additional surfaces of the lid and housing may also be disposed adjacent to each other in the closed position of the lid, depending on the position and size of the first surfaces. The total overlapping area between the surfaces of the lid and the surfaces of the housing may therefore be the same as the first overlapping area, or it may be larger.

Preferably, the first overlapping area is substantially the same as the total overlapping area so that the microsuction structure is provided over substantially the entire area in which the surfaces of the lid and the housing are overlapping. This would be the case, for example, where the microsuction structure is provided over substantially the entire surface of the laminar blank, as described above. Alternatively, the microsuction structure may only be provided in specific areas of the overlapping surfaces of the lid and the housing, so that the first overlapping area is less than the total overlapping area.

Preferably, the one or more resealable area of the microsuction structure over which the microsuction layer is exposed have a total surface area of at least 25 percent of the total overlapping area of the lid and the housing. Preferably, the total surface area of the resealable areas of the microsuction structure corresponds to 100 percent or less of the total overlapping area of the lid and the housing.

In some preferred embodiments, the microsuction layer is disposed directly adjacent to the corresponding first surface of the lid or housing. In this case, micro cavities on the inner surface of the microsuction layer are able to form a sealed environment of reduced pressure between the walls of the cavities and the underlying first surface of the lid or housing. In such embodiments, it is preferable for the microsuction layer to extend over the entirety of the corresponding first surface of the lid or housing, as this can help the microsuction layer to form a strong bond with the underlying surface. The underlying surface is preferably provided by the base material of the lid or housing, which is preferably a cellulose fibre based material, such as cardboard or paperboard.

In some other preferred embodiments, the microsuction structure further comprises an adhesive layer underlying the microsuction layer, the adhesive layer affixing the microsuction structure to the corresponding first surface of the lid or housing. In such embodiments, the adhesive layer can be used to adhere the rest of the microsuction layer to the underlying first surface of the lid or housing. The adhesive layer may be in direct contact with the microsuction layer. Alternatively, a polymeric film layer may be provided between the microsuction layer and the adhesive layer. Preferably, the polymeric film layer is a layer of a polyester film, particularly preferably a layer of polyethylene terephthalate (PET). Other suitable polymers for use in the polymeric film layer include but are not limited to polyethylene and oriented polypropylene. The microsuction layer is preferably fused directly onto the polymeric film layer, without an intermediate adhesive layer. Suitable adhesives for forming the adhesive layer may be water based adhesives or solvent based adhesives.

The microsuction structure as described is provided on at least one of the first surface of the lid and the first surface of the housing, so that the lid can be secured when the first surfaces are brought into contact with each other in the closed position of the lid.

In some preferred embodiments, a microsuction structure is provided on the first surface of the lid, and a microsuction structure is also provided on the first surface of the housing. This can enhance the retention effect provided by the microsuction structures as they can attach to each other when the lid is in the closed position.

Alternatively, in some other preferred embodiments, the microsuction structure is provided on only one of the first surface of the lid or the first surface of the housing. This can be advantageous as it means that only one surface of the lid or housing needs to be modified to incorporate an additional element. The remaining "contact" surface may therefore remain unmodified. However, in some such embodiments, it is preferred for the contact surface to have a surface smoothness of 1.2 micrometres or less as measured in accordance with ISO 8791-4, preferably a surface smoothness of 0.8 micrometres or less as measured in accordance with ISO 8791-4. This can improve the interaction between the microsuction structure and the contact surface of the lid or housing, and thereby improve the retention effect provided by the microsuction structure.

Such a surface smoothness may be provided by any suitable means. However, in some particularly preferred embodiments, the contact surface of the lid or housing comprises a coating layer to increase the surface smoothness. For example, the contact surface may comprise a coating layer of a varnish, such as an ultraviolet (UV) cured varnish. The varnish may be easy to apply locally to the contact surface of the lid or housing. This means that significant modification of the remainder of the container is not necessary, in order to ensure that contact surface has a desired smoothness of 1.2 micrometres or less.

The first surface of the lid or housing onto which the microsuction structure is applied may optionally be embossed in order to raise at least a part of the first surface relative to the surrounding surface of the container. This may advantageously enhance contact between the microsuction structure and the contact surface, in order to provide an optimised seal. Such embossing can be achieved using a high aspect ratio lacquer.

Where embossments are provided, the depth of the embossments is preferably between about 20 micrometres and about 100 micrometres, more preferably between about 30 micrometres and about 70 micrometres, most preferably between about 30 micrometres and about 50 micrometres. Preferably, at least about 50 percent of the first surface is covered by embossments, more preferably at least about 75 percent of the first surface and most preferably about 100 percent of the first surface.

Preferably, the microsuction structure is provided on the first surface of the housing. In such embodiments, the microsuction structure is preferably provided on the front wall of the housing such that there is at least one resealable area on the front wall of the housing. The corresponding first surface on the lid will therefore typically be the inner surface of the lid front wall. Alternatively or in addition, the microsuction structure may be provided on at least one of the side walls of the housing such that there is at least one resealable area on the side wall. In this case, the corresponding first surface of the lid will typically be the inner surface of the corresponding lid side wall.

Alternatively or in addition, the microsuction structure may be provided on the first surface of the lid. In such embodiments, the microsuction structure is preferably provided on the inner surface of the front wall of the lid such that there is at least one resealable area on the front wall of the lid. Alternatively or in addition, the microsuction structure may be provided on the inner surface of at least one of the side walls of the lid such that there is at least one resealable area on the side wall.

In one preferred embodiment, a first microsuction structure is provided on the outer surface of the front wall of the inner frame, and one or more additional microsuction structures are provided on the inner surface of each of the side walls of the lid. In another preferred embodiment, a first microsuction structure is provided on the inner surface of the lid front wall, and one or more additional microsuction structures are provided on the outer surface of each of the side walls of the inner frame.

The housing and lid of containers according to the invention may have any suitable structure. However, in some particularly preferred embodiments, the housing comprises a box comprising: a box front wall, a box back wall, first and second box side walls, and a box bottom wall, wherein the first surface of the housing is located on the box front wall. The lid is typically connected to the box along a hinge line extending across the back wall of the container. In such embodiments, in the closed position of the lid, at least part of the lid front wall overlies the box front wall and the first surface of the lid is located on the inner surface of the lid front wall.

As used herein the terms "side", "top", "bottom", "front", "back" and other terms used to describe relative positions of the components of containers according to the invention refer to the container in an upright position with the lid at the top and the box bottom wall at the bottom. When describing containers according to the present invention, these terms are used irrespective of the orientation of the container being described.

In other preferred embodiments of the invention, the housing comprises a box as defined above and an inner frame mounted within the box, wherein the first surface of the housing is located on the inner frame. In such embodiments, the walls of the inner frame extend beyond the top edges of the corresponding walls of the box at the opening of the housing so that when the lid is in the closed position, the walls of the lid overlie the corresponding walls of the portion of the inner frame extending above the box. In some particularly preferred embodiments, the microsuction structure is provided on the first surface of the housing, on the inner frame. The first surface of the lid may or may not be provided with an additional microsuction structure.

Where the microsuction structure is provided on the inner frame, as described above, the microsuction structure may be provided over a specific area or areas of the inner frame surface. More preferably, the microsuction structure is provided over substantially the entire outer surface of the inner frame. In this case, the microsuction structure can conveniently be applied as a single, continuous element on the surface of the inner frame to provide a laminated inner frame. The inner frame can be provided with the microsuction structure prior to the assembly of the container so that the container assembly process is substantially unaffected by the inclusion of the microsuction structure on the inner frame.

Where the microsuction structure is provided on the inner frame, the microsuction structure may additionally be used to affix the inner frame to the inner surface of the box. Conventionally, such inner frames are affixed to the inner surface of the box by means of an adhesive. However, by leaving one or more portions of the microsuction layer exposed in the region of the inner frame that underlies the inner surface of the box, the microsuction layer itself can be used to help affix the inner frame to the inner surface of the box. This can advantageously reduce or eliminate the amount of adhesive needed.

In such embodiments in which the microsuction structure covers substantially the entire outer surface of the inner frame, the microsuction structure preferably comprises an inactivation layer as described above, to define specific resealable areas on the inner frame walls, in which the microsuction layer is exposed. This enables the area over which the lid will become sealed to the inner frame in the closed position of the lid to be controlled so that the force required to open the lid is appropriate for the consumer. Preferably, at least one resealable area is provided on the front wall of the inner frame. Alternatively or in addition, at least one resealable area may be provided on a side wall of the inner frame, or on both side walls of the inner frame.

In any of the embodiments described above in which the housing comprises a box, the lid may comprise a flap that is hinged to the box, the flap comprising a top flap portion that overlies the top of the box when the flap is in the closed position and a front flap portion that at least partly overlies the box front wall when the flap is in the closed position, and wherein the first surface of the lid is located on the inner surface of the front flap portion. Preferably, the box comprises a top wall at least partially defining the opening for accessing the consumer goods, in which the opening extends across the top wall from the front edge of the top wall and wherein the periphery of the opening is spaced apart from the rear edge and the side edges of the top wall so that the top wall extends around the rear and sides of the opening. Preferably, the opening also extends part way down the box front wall from the front edge of the box top wall, and when the flap is in the closed position, the front flap portion overlies the part of the opening that extends part way down the box front wall and also overlies at least a part of the overlies the box front wall.

Alternatively, in any of the embodiments described above in which the housing comprises a box, the lid may comprise a lid front wall, a lid back wall, first and second lid side walls, and a lid top wall, and wherein the first surface of the lid is located on the inner surface of the lid front wall. Preferably, the lid front wall comprises a lid front wall outer panel defining the outer surface of the lid front wall, and a lid front wall under panel defining the inner surface of the lid front wall. In such an embodiment, the lid front wall under panel depends from and underlies the lid front wall outer panel. This arrangement is particular advantageous for embodiments in which the container is formed from a folded laminar blank, and in which the first (inner front wall) surface of the lid is provided with a varnish, because the varnish can to be applied to the first (inner front wall) surface of the lid using existing manufacturing machinery and techniques.

Preferably, the microsuction layer is exposed over a surface area of at least 1 centimetre squared on the first surface of the lid or the first surface of the housing, more preferably at least 2 centimetres squared on the first surface of the lid or the first surface of the housing, even more preferably at least 3 centimetres squared on the first surface of the lid or the first surface of the housing. Preferably, the microsuction layer is exposed over a surface area of less than 10 centimetres squared on the first surface of the lid or the first surface of the housing, more preferably of less than 5 centimetres squared on the first surface of the lid or the first surface of the housing. This corresponds to the total surface area of the resealable areas.

Preferably, the microsuction structure has a total thickness of less than about 300 micrometres, more preferably a thickness of less than about 150 micrometres, even more preferably a thickness of less than about 50 micrometres. Preferably, the microsuction structure has a thickness of at least about 20 micrometres, more preferably at least about 60 micrometres. Ensuring that the thickness of the microsuction structure is within the aforementioned ranges eliminates the need for significant modification of the container dimensions.

Preferably, the microsuction structure is provided such that the force required to separate the lid from the housing when the lid is in the closed position is less than about 15 Newtons. This can ensure that the container is still relatively easy to open when a consumer wishes to access the consumer goods.

Preferably, the force required to separate the lid from the housing when the lid is in the closed position is at least about 2 Newtons, more preferably at least about 5 Newtons. This can reduce the likelihood of the lid accidentally being opened during normal handling of the container, for example, when the container is in a consumer's pocket.

The term "panel" is used herein to refer to a portion of the container formed from a single, continuous portion of material. A panel may depend along one or more weakening lines from one or more other panels. The term "flap" refers to a panel that depends along only one weakening line from only one other panel.

The term "wall" refers more generally to a facet of the container, and a wall may be formed from a single panel or flap, or a wall may be formed from two or more abutting or overlapping panels or flaps.

Containers produced by methods according to the present invention are preferably in the form of a hard-pack container which has a relatively rigid three dimensional structure.

Containers according to the present invention find application for consumer goods, in particular elongate consumer goods such as smoking articles. Preferably, the container contains a bundle of smoking articles within the housing. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Preferably, the container is formed from one or more folded laminar blanks. The one or more folded laminar blanks may be formed from any suitable material or combination of materials, including, but not limited to, cardboard, paperboard, plastic, metal, or combinations thereof. Preferably, the blank is a laminar cardboard blank having a weight of between about 100 grams per square metre and about 350 grams per square metre. In preferred embodiments, the blank has a thickness of from about 200 to about 400 micrometres, more preferably from 250 micrometres to 350 micrometres.

The container is preferably a rectangular parallelepiped container comprising two wider walls spaced apart by two narrower walls. A hinge lid container shall typically comprise two longitudinal rounded or beveled edges on the front wall, and/or two longitudinal rounded or beveled edges on the back wall. These may optionally be in combination with one or more rounded or beveled transverse edges.

The exterior surfaces of containers according to the invention may be printed, embossed, debossed or otherwise embellished with manufacturer or brand logos, trade marks, slogans and other consumer information and indicia.

According to a second aspect of the present invention there is provided a method for forming a component of a container for consumer goods, such as the containers described above in respect of the first aspect of the present invention. The method comprises: providing a first blank, which is preferably configured to be folded to form at least part of the container comprising: a housing having an opening for accessing the consumer goods; and a lid connected to the housing and movable relative to the housing between a closed position in which the lid covers the opening and an open position in which the opening is uncovered; wherein a first surface of the lid is disposed adjacent to a first surface of the housing when the lid is in the closed position. At least a portion of the first blank comprises a first surface preferably corresponding to the first surface of the lid or the first surface of the housing; covering at least a portion of the first surface with a microsuction layer; covering a first portion of the microsuction layer with a inactivation layer to form a microsuction structure on the first surface of the first blank, a second portion of the microsuction layer being exposed at the outer surface of the microsuction structure to define at least one resealable area of the microsuction structure; and folding the first blank to form a component of a container for consumer goods. The method of the second aspect of the invention is advantageous since the microsuction layer can be applied across a greater extend of the first surface to thereby form a more secure bond, and without a need for precise registration. The inactivation layer can then be applied over the microsuction layer, using for example more conventional manufacturing processes—such as printing—to thereby precisely define the locations and sizes of the one or more resealable areas.

Preferably, the step of covering at least a portion of the first surface with a microsuction layer includes: covering the entirety of the first surface with the microsuction layer.

The microsuction layer and the inactivation layer may be provided on the blank in one single step, for example, when said layers are already attached to one another. Alternatively, in some embodiments, it is preferable to first provide the microsuction layer on the blank, and then subsequently provide the inactivation layer over a portion of the microsuction layer. These two steps may be performed at different manufacturing stations, which may be at different manufacturing sites. For example, the microsuction layer may be provided on the blank by applying a resin on the blank, which sets to form the microsuction layer. The blank with the microsuction layer may then be passed to a separate station, such as a printing station, where the inactivation layer can be applied over a portion of the microsuction layer. In this way, the microsuction layer can be easily incorporated into the blank, and the location and size of the one or more resealable areas can be easily and precisely controlled. This can be a more desirable manufacturing process than one which requires relatively small portions of a microsuction layer to be located on specific portions of a blank.

It will be appreciated that any of the features described above in reference to the first aspect of the invention may also be equally applicable to the second aspect of the invention.

Figure 2:
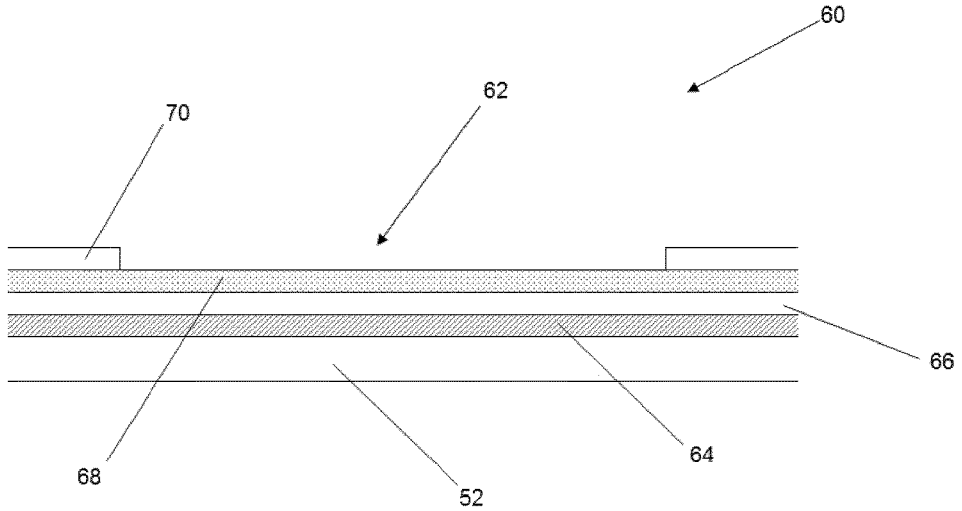

The invention will be further described, by way of example, with reference to the drawings in which:

FIG. 1 is a perspective view of a container according to the present invention; and FIG. 2 is an enlarged partial cross-sectional view of the microsuction structure on the front wall of the inner frame of the container of FIG. 1 (not to scale).

FIG. 1 shows a container 100 for consumer goods, according to an embodiment of the present invention, where the container 100 is in an open condition. The container 100 contains a wrapped bundle of consumer goods 60, such as a bundle of cigarettes. The container is formed from a folded laminar blank and has a lid 40 and a housing, the housing comprising a box 20 and an inner frame 50 mounted within the box 20.

The lid 40 has a first lid side wall 42, a second lid side wall 44, and a lid top wall 46. The lid 40 also has a lid front wall 48 and a lid back wall (not shown).

The box 20 has a box front wall 22, and a first box side wall 24. The box 20 also has a box bottom wall, a box back wall and a second box side wall (not shown). The lid 40 depends along a hinge line (not shown) from a top edge of the box back wall, and is movable about the hinge line between an open position (as shown in FIG. 1) and a closed position (not shown).

The inner frame 50 is attached to the inside of the box 20 and includes a first inner frame side wall 54, a second inner frame side wall (not shown), and an inner frame front wall 52.

A microsuction structure 60 is provided over the entire outer surface of the inner frame 50 and comprises a resealable area 62 on the inner frame front wall 52, which is configured to engage with the inner surface of the lid front wall 48 to retain the lid 40 in a closed position relative to the box 20.

FIG. 2 shows a partial cross-sectional view of the microsuction structure 60 provided on the outer surface of the inner frame 50. The microsuction structure 60 is formed of a laminate sheet material comprising several layers overlying one another, which covers the entire outer surface of the inner frame 50. An adhesive layer 64 adheres the microsuction structure 60 to the outer surface of the inner frame 50. A polymeric film layer 66 formed of a film of PET is adhered onto the adhesive layer 64 and a microsuction layer 68 overlies the polymeric film layer 66. The microsuction layer 68 is exposed in an area on the surface of the inner frame front wall 52 and this exposed area provides the resealable area 62 described above. The remainder of the microsuction layer 68 is covered by an inactivation layer 70 of a lacquer. The inactivation layer 70 is applied over the microsuction layer 68 and prevents the microsuction layer 68 from adhering to the lid, other than in the resealable area 62.

As described above, the areas to which the inactivation layer 70 is applied may be printed with a suitable ink prior to the application of the inactivation layer 70 onto the microsuction layer 68, in order to modify the surface appearance in these areas.

To close the container the consumer pivots the lid 40 about the hinge relative to the box 20, until the inner surface of the lid front wall 48 is adjacent to the outer surface of the inner frame front wall 52. The application of pressure to the outer surface of the lid front wall 42 causes the resealable area 62 of the microsuction structure 60 on the inner frame front wall 52 to engage with the inner surface of the lid front wall 48, and thereby retain the lid 40 in the closed position.

It will be appreciated that in alternative embodiments, the application of the lacquer layer 70 may be adapted to provide one or more additional resealable areas in which the microsuction layer is exposed at the surface of the inner frame. For example, an additional resealable area may be provided on one or both of the inner frame side walls.

The invention claimed is:

1. A container for consumer goods, the container comprising:

a housing having an opening for accessing the consumer goods; and a lid connected to the housing and movable relative to the housing between a closed position in which the lid covers the opening and an open position in which the opening is uncovered;

wherein a first surface of the lid is disposed adjacent to a first surface of the housing when the lid is in the closed position, and wherein a microsuction structure is provided on the first surface of the housing, the first surface of the lid, or both the first surface of the housing and the first surface of the lid, for securing the first surface of the lid to the first surface of the housing when the lid is in the closed position, and wherein the microsuction structure comprises:

an inactivation layer; and a microsuction layer, the microsuction layer comprising:

a first portion which underlies the inactivation layer; and a second portion which is exposed at the outer surface of the microsuction structure to define at least one resealable area of the microsuction structure.

2. A container according to claim 1, wherein the microsuction structure further comprises one or more additional layers disposed between the inactivation layer and the microsuction layer.

3. A container according to claim 1, wherein the microsuction layer extends over the entirety of the corresponding first surface of the lid or housing.

4. A container according to claim 1, wherein the microsuction layer is disposed directly adjacent to the corresponding first surface of the lid or housing.

5. A container according to claim 1, wherein the microsuction structure further comprises an adhesive layer underlying the microsuction layer, the adhesive layer affixing the microsuction structure to the corresponding first surface of the lid or housing.

6. A container according to claim 5, further comprising a polymeric film layer between the microsuction layer and the adhesive layer.

7. A container according to claim 1, wherein a microsuction structure is provided on the first surface of the lid, and a microsuction structure is provided on the first surface of the housing.

8. A container according to claim 1, wherein the microsuction structure is provided on only one of the first surface of the lid or the first surface of the housing, and wherein the other of the first surface of the lid or the first surface of the housing has a surface smoothness of 1.2 micrometres or less as measured in accordance with ISO 8791-4.

9. A container according to claim 8, wherein the other of the first surface of the lid or the first surface of the housing comprises a coating layer.

10. A container according to claim 1, wherein the first surface of the lid or the first surface of the housing to which the microsuction structure is applied is embossed beneath the microsuction structure.

11. A container according to claim 1, wherein the housing comprises an inner frame and wherein the first surface of the housing is provided on the outer surface of the inner frame.

12. A container according to claim 1, wherein the lid comprises a lid front wall, a lid back wall, first and second lid side walls, and a lid top wall, and wherein the first surface of the lid is located on the inner surface of the lid front wall.

13. A container according to claim 1, wherein the housing comprises a box comprising: a box front wall, a box back wall, first and second box side walls, and a box bottom wall, and wherein the first surface of the housing is located on the box front wall.

14. A method for forming a component of a container for consumer goods, the method comprising:

providing a first blank, which is configured to be folded to form at least part of the container comprising: a housing having an opening for accessing the consumer goods; and a lid connected to the housing and movable relative to the housing between a closed position in which the lid covers the opening and an open position in which the opening is uncovered; wherein a first surface of the lid is disposed adjacent to a first surface of the housing when the lid is in the closed position, and wherein at least a portion of the first blank comprises a first surface corresponding to the first surface of the lid or the first surface of the housing;

covering at least a portion of the first surface with a microsuction layer;

covering a first portion of the microsuction layer with a inactivation layer to form a microsuction structure on the first surface of the first blank, a second portion of the microsuction layer being exposed at the outer surface of the microsuction structure to define at least one resealable area of the microsuction structure; and folding the first blank to form a component of a container for consumer goods.

15. A method according to claim 14, wherein the step of covering at least a portion of the first surface with a microsuction layer includes:

covering the entirety of the first surface with the microsuction layer.

* * * * *